US008939671B2

(12) United States Patent
Ziadeh et al.

(10) Patent No.: US 8,939,671 B2
(45) Date of Patent: Jan. 27, 2015

(54) TOOTHBRUSH WITH AUTOMATIC PASTE DISPENSING MECHANISM

(71) Applicants: Michael J. Ziadeh, Dublin, CA (US); Braden L. Smith, Lafayette, CO (US)

(72) Inventors: Michael J. Ziadeh, Dublin, CA (US); Braden L. Smith, Lafayette, CO (US)

(73) Assignee: EZE Products, Inc., Livermore, CA (US)

( * ) Notice: Subject to any disclaimer, the term of this patent is extended or adjusted under 35 U.S.C. 154(b) by 26 days.

(21) Appl. No.: 13/766,356

(22) Filed: Feb. 13, 2013

(65) Prior Publication Data

US 2013/0209158 A1 Aug. 15, 2013

Related U.S. Application Data

(60) Provisional application No. 61/633,479, filed on Feb. 13, 2012.

(51) Int. Cl.

| | |
|---|---|
| ***A46B 11/04*** | (2006.01) |
| ***A46B 11/00*** | (2006.01) |
| ***A46B 17/04*** | (2006.01) |

(52) U.S. Cl.

CPC ..... *A46B 11/0006* (2013.01); *A46B 11/0031* (2013.01); *A46B 11/0062* (2013.01); *A46B 17/04* (2013.01); *A46B 2200/1066* (2013.01)

USPC ..... 401/284; 401/116; 401/175; 401/277

(58) Field of Classification Search

CPC ..... A46B 11/001; A46B 11/002; A46B 11/0024; A46B 11/0027; A46B 11/0031; A46B 11/0034; A46B 11/0037; A46B 11/0058; A46B 11/0062; A46B 2200/1066

USPC ..... 401/270, 277, 116, 117, 175, 172, 171, 401/75, 284

See application file for complete search history.

(56) References Cited

U.S. PATENT DOCUMENTS

| | | | | | |
|---|---|---|---|---|---|
| 2,025,591 | A | * | 12/1935 | Folsom-Jones | 401/101 |
| 3,816,007 | A | * | 6/1974 | Fox | 401/146 |
| 4,056,110 | A | * | 11/1977 | Landsman | 132/311 |
| 4,221,492 | A | | 9/1980 | Boscardin et al. | |
| 4,467,822 | A | | 8/1984 | Blackwell | |
| 4,695,177 | A | * | 9/1987 | Kuo | 401/150 |
| 5,066,155 | A | | 11/1991 | English et al. | |
| D322,172 | S | | 12/1991 | Cheng | |
| 5,244,298 | A | | 9/1993 | Greenhouse | |

(Continued)

FOREIGN PATENT DOCUMENTS

| | | | |
|---|---|---|---|
| EP | 0385815 | A2 | 9/1990 |
| WO | WO 83/03742 | A1 | 11/1983 |
| WO | WO 97/05043 | A1 | 2/1997 |

OTHER PUBLICATIONS

International search report and written opinion dated Jun. 3, 2013 for PCT/US2013/025996.

*Primary Examiner* — David Walczak

(74) *Attorney, Agent, or Firm* — Wilson Sonsini Goodrich & Rosati

(57) ABSTRACT

A toothbrush system has a stem and an integrated paste dispenser disposed in a protective case. The stem may be manually advanced from the protective case to position a brush head for use. While the stem is being advanced, the integrated paste dispenser delivers a line of toothpaste along the top of the brush head bristles so that the toothbrush can be deployed and the toothpaste applied to the bristles in a single step.

15 Claims, 10 Drawing Sheets

(56) References Cited

U.S. PATENT DOCUMENTS

| | | | | |
|---|---|---|---|---|
| 5,842,605 | A | 12/1998 | Lehmkuhl | |
| 5,975,782 | A * | 11/1999 | Lee | 401/144 |
| 6,056,466 | A | 5/2000 | Johnson et al. | |
| 6,257,791 | B1 | 7/2001 | Scamard | |
| 6,533,485 | B1 | 3/2003 | Bland | |
| 6,793,433 | B2 | 9/2004 | Giraldo | |
| 7,070,353 | B2 | 7/2006 | Bostal | |
| 7,128,492 | B1 | 10/2006 | Thames, Jr. | |
| 7,293,928 | B2 | 11/2007 | Lane | |
| 7,617,828 | B1 | 11/2009 | Sinha | |
| 2004/0028456 | A1 | 2/2004 | Giraldo | |
| 2005/0002726 | A1 | 1/2005 | Bostal | |
| 2006/0269354 | A1 | 11/2006 | Lane | |
| 2007/0028941 | A1 | 2/2007 | Oronsky et al. | |
| 2007/0183838 | A1 | 8/2007 | Umar | |
| 2012/0102638 | A1 | 5/2012 | Al-Mahnna | |

* cited by examiner

TOOTHBRUSH WITH AUTOMATIC PASTE DISPENSING MECHANISM

CROSS-REFERENCE TO RELATED APPLICATIONS

This application claims the benefit of Provisional Application No. 61/633,479, filed Feb. 13, 2012, the full disclosure of which is incorporated herein by reference.

BACKGROUND OF THE INVENTION

1. Field of the Invention

The present invention relates generally to oral care products and more particularly to a combination toothbrush and toothpaste dispenser.

Oral care in general and tooth brushing in particular should be performed regularly and regardless of location. Teeth should be brushed at least three times a day, and there are many instances where a person might want to brush their teeth even more often such as before business meetings, social events, and of course before visiting the dentist. While most people are well prepared to brush their teeth at home, brushing teeth away from home can be difficult, particularly when traveling and away from both home and the office.

One solution that has been proposed to ease the difficulties of truth brushing away from home is the use of a toothbrush having a combined or integrated toothpaste dispenser. Such "all-in-one" toothbrushes eliminate the need to carry both a toothbrush and separate toothpaste container and can sometimes be made small enough to carry in a pocket, purse, or other convenient location. Often, the combined toothbrush/toothpaste dispensers are intended for single use or a limited number of uses, thus reducing the challenge of keeping the toothbrush sanitary for multiple uses.

While an excellent idea with potentially great value, the designs more for toothbrushes with integrated toothpaste dispensers have thus far been lacking in one or respects. For example, most combined toothbrush/toothpaste dispensers rely on storing the toothpaste in the handle of an otherwise generally normal looking toothbrush. The toothpaste is then squeezed or otherwise forced from the handle into the brush head of the toothbrush, typically entering from the bottom of the brush head. Such designs are far from optimum since it can be difficult to squeeze the handle in order to advance the toothpaste and most people do not like and/or are not used to the toothpaste being dispensed on the bottom of the brush head rather than the top.

While one design shown in U.S. Pat. No. 4,467,882 does attempt to place the toothpaste on top of the brush head (FIGS. 7 and 7A), this design suffers from other shortcomings. The toothpaste is dispensed through a nozzle into a single location in the middle of the brush head and does not spread across the top or crown of the brush head as most people desire. Second, the paste is dispensed while the brush head is hidden within a cavity in the toothbrush handle, making it difficult to confirm that the toothpaste has been dispensed. Dispensing within the handle can also cause scrapping or otherwise dislodge the toothpaste from the brush head as the brush head is advanced from the handle. Finally, the toothbrush/toothpaste dispenser of the '822 patent requires separate dispensing and brush head advancement actions by the user. Such separation of the brush head advancement and dispensing actions makes the toothbrush less convenient to use.

For these reasons, improved toothbrush systems combining both a brush head advancement mechanism and a toothbrush dispenser would be desirable. In particular, it would be desirable if the motion of the brush head advancement mechanism were coupled to the toothbrush dispenser so that these motions can be properly coordinated. It would still be further desirable if toothpaste were dispensed from the dispenser as the brush mechanism is advanced so that a line of toothpaste along the crown of the brush head can be placed in a manner which is familiar to most users. Finally, it would be desirable if the designs were particularly compact and if, optionally, it were possible to refill the dispenser portion of the brush with additional toothpaste. At least some of these objectives will be met by the inventions described below.

2. Description of the Background Art

U.S. Pat. No. 4,467,822, was described above. Other relevant patents and publications showing toothbrushes with integrated dispensing mechanisms include U.S. Pat. Nos. 4,221,492; 5,842,605; 6,056,466; 6,257,791; 6,533,485; 6,793,433; 7,070,353; 7,128,492; 7,293,928; 7,617,828; US2004/0028456; US2005/0002726; US2006/0269354; US2007/0028941; US2007/0183838; US2012/0102638; Des. 322,172; WO83/03742; WO97/05043; and EP0385815.

SUMMARY OF THE INVENTION

The present invention provides improved toothbrush systems having integrated toothpaste dispensing mechanisms. While the toothbrush systems of the present invention may find their greatest use away from home when a user does not have access to more conventional toothbrushes used with separate toothpaste dispensers, the systems and methods of the present invention could be used at home as a primary oral care product as well. The toothpaste dispenser is integrated in a housing or protective cover together with the brush head in a manner such that both the brush head and the dispenser can be covered and protected until the user is ready to use the system. After opening the protective case, typically by removing a cover, the user is able to in a single motion advance a stem which carries the brush head from the protective case and simultaneously dispense a volume of toothpaste along the brush head so that the paste is evenly distributed along all or most of the top or crown of the brush head in a manner familiar to most users. After use, the brush head may be washed and the stem retracted back into the protective case and, at least in most embodiments of the present invention, the toothbrush will be ready for second and additional uses until an initial amount of toothpaste held in the protective case has been fully dispensed in multiple volumes for multiple uses. In some instances, a toothpaste receptacle within the protective case can be refilled and in other instances it may be possible to provide cartridges or other convenient paste packages which can be reintroduced into the protective cover allowing continued use of the toothbrush.

In a first aspect of the present invention, a toothbrush system includes an integrated paste dispenser. The toothbrush system comprises a protective case, a stem, and a paste dispenser. The protective case would usually have both an open and a closed position where the stem and the paste dispenser will be in an interior portion of the protective case and will be fully protected when the protective case is closed. As specifically illustrated hereinafter, the protective case may have a removable cover but other ways of opening and closing the protective case could also be used, such as having a hinged cover, which opens axially in a claim "shell" design, or the like.

The stem has a distal end, a proximal end, and carries a brush head at its distal end. The brush head may have any conventional design for a toothbrush head. The stem is mounted to slide axially in the protective case in order to move the brush head between an extended position, where the brush head is distal to the protective case, and a retracted position where the brush head is within the protective case.

The paste dispenser is also mounted at least partly within the protective case and has a nozzle at a distal end thereof. The stem is mechanically coupled to the paste dispenser in order to cause the paste dispenser to deliver a volume of paste to the brush head each time the stem is distally advanced. As a paste receptacle within the protective cover will typically carry sufficient toothpaste for multiple uses, and the mechanical coupling of the stem to the paste dispenser will be arranged to allow the stem to be advanced to deliver the volume of paste and then to be retraced so that the stem may then be advanced one or more additional times to deliver additional volumes of the paste.

In the exemplary embodiments, the nozzle of the paste dispenser is disposed adjacent to the brush head when the brush head is in the protective case. In this way, as the stem is advance and carries the brush head past the nozzle, the nozzle can lay or distribute paste along the top or crown of the brush head. The coupling of the stem and the tooth dispenser will also be arranged so that the dispensing of the paste terminates at or near the position where the brush head moves distally away from the nozzle. In this way, paste can be dispensed along the entire upper surface of the brush head but will only be delivered while the brush head is adjacent to the nozzle.

In an exemplary coupling or drive mechanism, the stem includes a gear which rotates as the stem is axially advanced. The paste dispenser includes a threaded rod with a gear arranged to engage a gear on the stem so that advancement of stem drives and rotates the threaded rod to axially advance the piston within a toothpaste receptacle in the protective case. In this way, the piston can force or dispense the paste out onto the brush head as the brush head is advanced. Also, use of the threaded rod allows incremental advancement of the piston so that the piston will advance as the stem is advanced but will not retract when the stem is retraced. In this way, multiple, sequential uses of the toothbrush will incrementally advance the piston and dispense volumes of the toothpaste until the entire volume of toothpaste within the toothpaste receptacle is emptied. The toothpaste receptacle will typically be sufficiently large to hold multiple volumes of toothpaste so that one volume can be dispensed each time the stem is advanced up to a multiple number of times.

In more specific embodiments to the present invention, the stem will comprise a hollow distal portion and a rotating proximal portion. The hollow distal portion carries a boss that travels in a channel formed on the proximal portion, where the distal and proximal portions are generally in the form of a distal "cylinder" having a reciprocating proximal "shaft" therein. At least a portion of the channel formed in the proximal portion will be helical so that axial advancement of the distal portion of the stem over the proximal portion will cause the proximal portion to rotate (while the distal portion is prevented from rotating by travel of a slide button in a slot on the protective cover as described in more detail below). Usually, the helical region will cover only part of the length of proximal portion of the stem with the remainder being linear. Thus, the initial travel of the distal portion of the stem over the proximal portion will cause helical rotation of the gear and dispense paste while the remaining portion of the travel will not dispense any additional paste. This allows full extension of the stem to position the brush head in a comfortable position relative to the protective cover while still dispensing an appropriate amount of toothpaste in the initial portion of the travel.

In further specific embodiments, the stem, and more particularly the distal portion of the stem, will have a button which travels in a slot formed in the side of the protective case so that a user can advance the brush head and dispense the toothpaste with a single advancement of the button. As just mentioned previously, travel of the button in the slot will prevent rotation of the distal portion of the stem and cause the proximal portion of the stem to rotate as the distal portion is advanced.

In a still further specific embodiment of the present invention, a knob or other rotating mechanism can be provided on the rod of the paste dispenser. The knob allows a user to manually rotate the rod and advance or retract the piston. In particular, the rod may be rotated to retract the piston when refilling the toothpaste receptacle as will be described in more detail below.

In a second aspect of the present invention, methods for dispensing toothpaste comprise providing a toothpaste system including a protective cover, a stem having a brush head at its distal end, and a paste dispenser. The stem is distally advanced relative to the protective cover to advance the brush head distal to the protective cover. Distally advancing the stem causes the paste dispenser, usually located within the protective cover, to deliver a quantity of toothpaste to the brush head as the brush head moves by a nozzle which is part of the dispenser.

The methods of the present invention may further comprise proximally retracting the stem to draw the brush head back into the protective cover for convenient storage prior to reuse. The stem may then be advanced one or more additional times to cause the paste dispenser to deliver one or more additional quantities of toothpaste to the brush head as the brush head moves by the nozzle.

In specific embodiments, advancing the stem may comprise sliding a button on the side of the protective cover, and paste may be dispensed during an initial portion of the travel of the stem only and not be dispensed during the remaining portion of the travel of the stem. As described above, this allows the brush head to be fully advanced without delivering more paste than is needed.

In further specific embodiments, advancement of the stem cause the paste dispenser to advance a piston within the protective cover to deliver the quantity of toothpaste, typically from within a toothpaste receptacle inside of the protective cover. Once the toothpaste is fully used, the methods of the present invention may further comprise aligning the nozzle with the source of toothpaste and retracting the piston to draw toothpaste from the source back into the protective cover, typically within the toothpaste receptacle until filled.

DETAILED DESCRIPTION OF THE INVENTION

Figure 1:
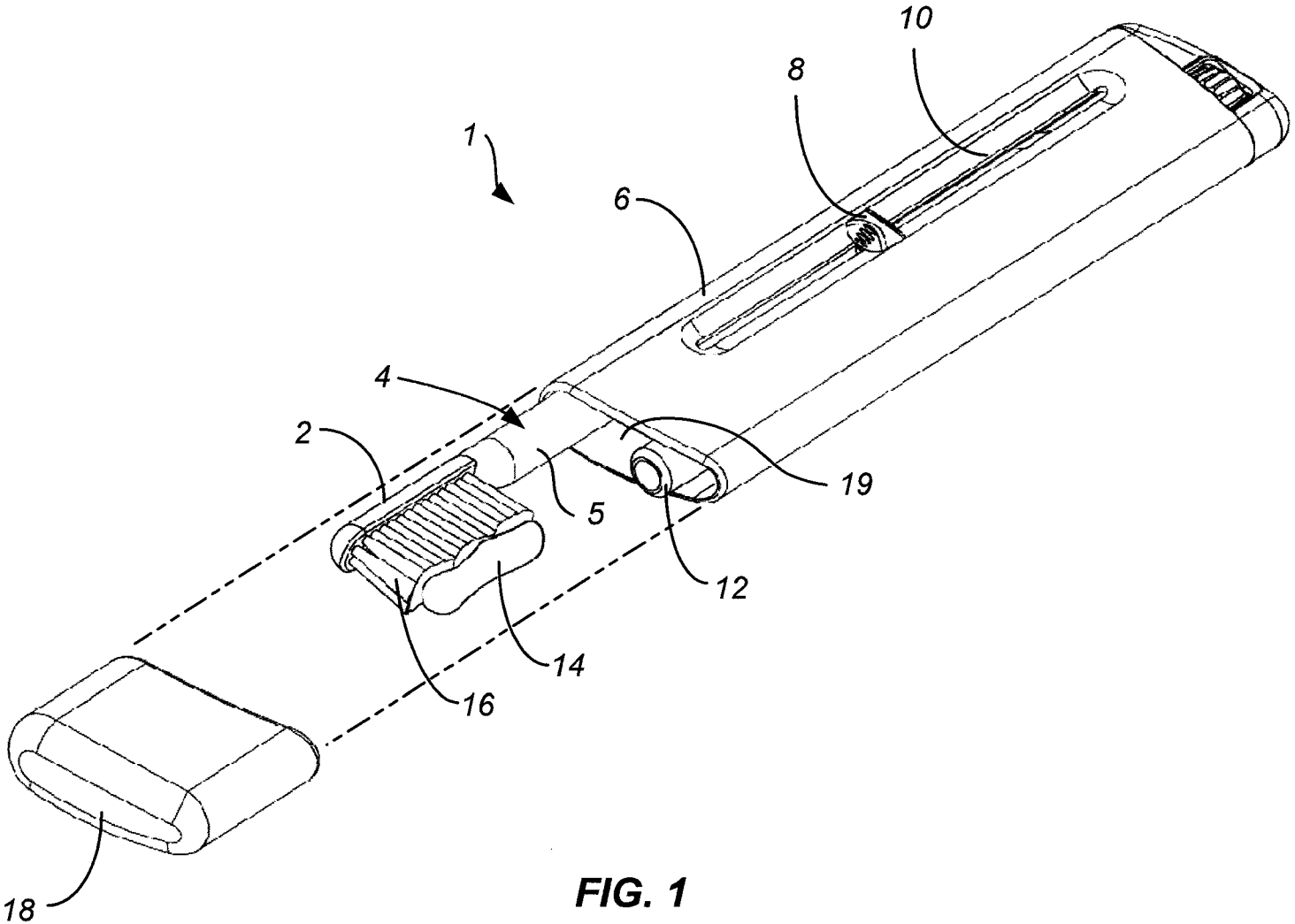
FIG. 1 is an isometric view of the toothbrush system of the present invention shown with the cover removed from the protective case and the toothbrush head extended partially from the protective cases with a volume of toothpaste thereon.

Referring to FIG. 1, a travel toothbrush 1, made of mostly plastic or other suitable material, has a toothbrush head 2, of any conventional design, shown partially extended and attached to a toothbrush stem assembly 4 having a distal portion, typically a sleeve 5, which may be slidablely advanced or retracted into a protective case 6. A button 8 is attached to a proximal end of the sleeve 5 of the stem assembly 4. Using the button 8, a user can manually advance the sleeve 5 to extend the toothbrush head 2 out of the protective case 6 by sliding it along an open slot or track 10 formed in a side of the protective case. When the user slides the toothbrush head out of the case, a nozzle 12 of a paste dispenser assembly (FIG. 2) dispenses a volume or portion 14 of toothpaste onto an upper surface of bristles 16 of the toothbrush head 2. A removable cover 18 can be placed over an open distal end 19 of the protective cover 6 to protect the travel toothbrush head 2 and dispenser nozzle 12 from dirt and other contaminants when the toothbrush is not being used.

Figure 2:
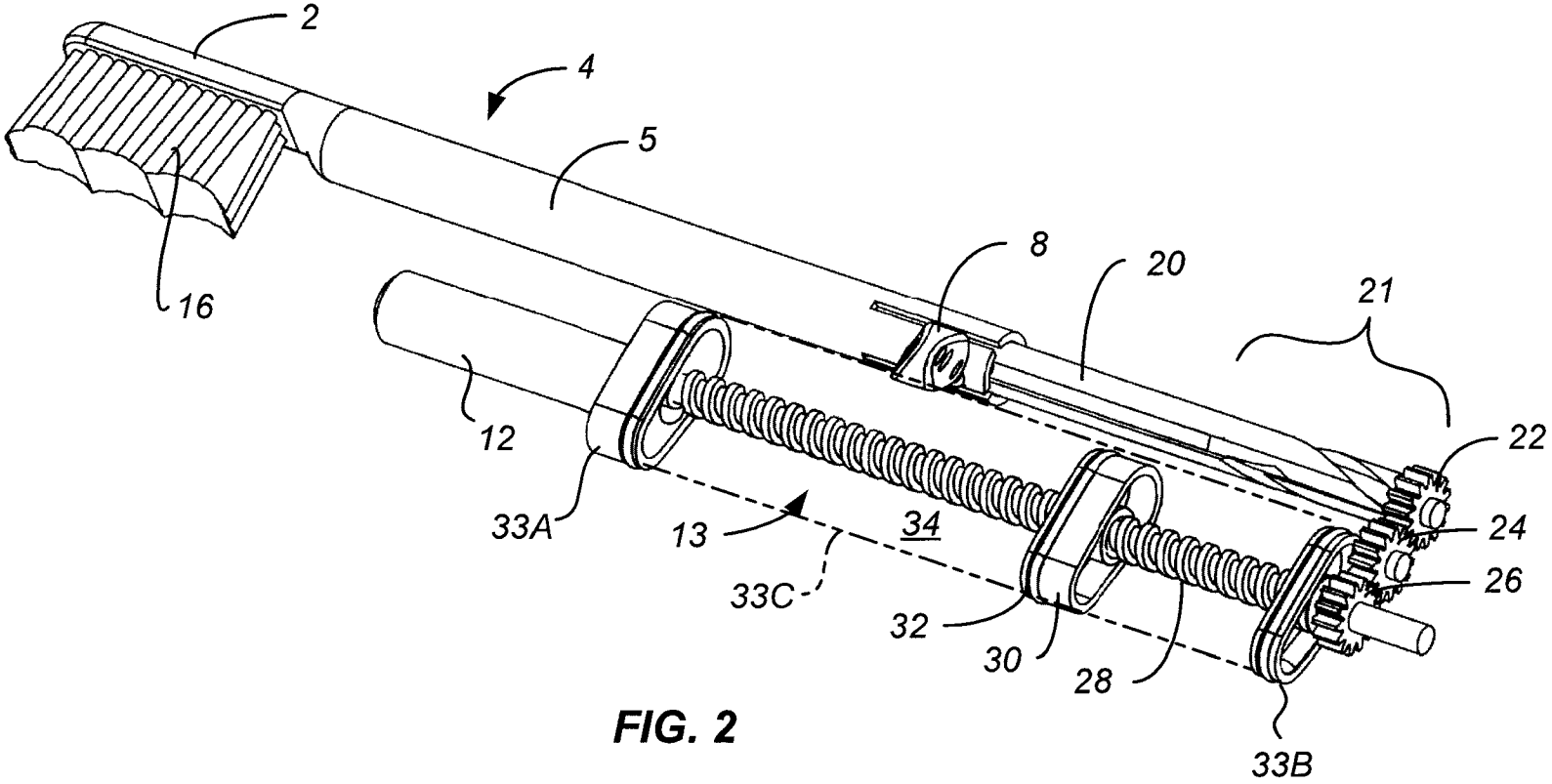
FIG. 2 is an isometric view of the stem which carries the brush head and the toothpaste dispenser assembly of an exemplary embodiment of the toothbrush system of the present invention.

Referring now to FIG. 2, the stem assembly 4 and paste dispensing assembly 13 of travel toothbrush 1 are shown with the protective case 6 case removed to expose the inner parts. The sleeve 5 of the toothbrush stem assembly 4 slides over a rotating rod or shaft 20. A rotating mechanism 21 formed over a proximal region of the shaft 20 rotates a first gear 22 which engages and rotates a second gear 24 that in turn rotates a third gear 26. The third gear is affixed to a threaded shaft 28 which is part of the paste dispensing assembly 13. Rotation of the threaded shaft 28 advances a piston 30 having a rubber seal 32 about its circumference within a paste receptacle region 34 formed in the interior of the protective cover. The paste receptacle region is defined by end members 33A and 33B and an interior wall 33C (shown in broken line) with an ovoid cross-section which conforms to the periphery of the rubber seal 32 of the piston 30. The paste receptacle 34 is initially filled with tooth paste so that distal advancement of the piston 30 will drive toothpaste through the nozzle 12.

In other embodiments, the paste receptacle can be removable and replaceable. For example, the paste receptacle can be formed similarly to a hypodermic injection carpule with a dispensing end and a plunger end. The piston 30 can be modified to engage the plunger of the carpule-like paste receptacle, and the dispensing end can be aligned with the nozzle 12. The only other significant change would be that the carpule-like paste receptacle would have to be modified to fit over or otherwise accommodate the presence of the threaded shaft.

Figure 3A:
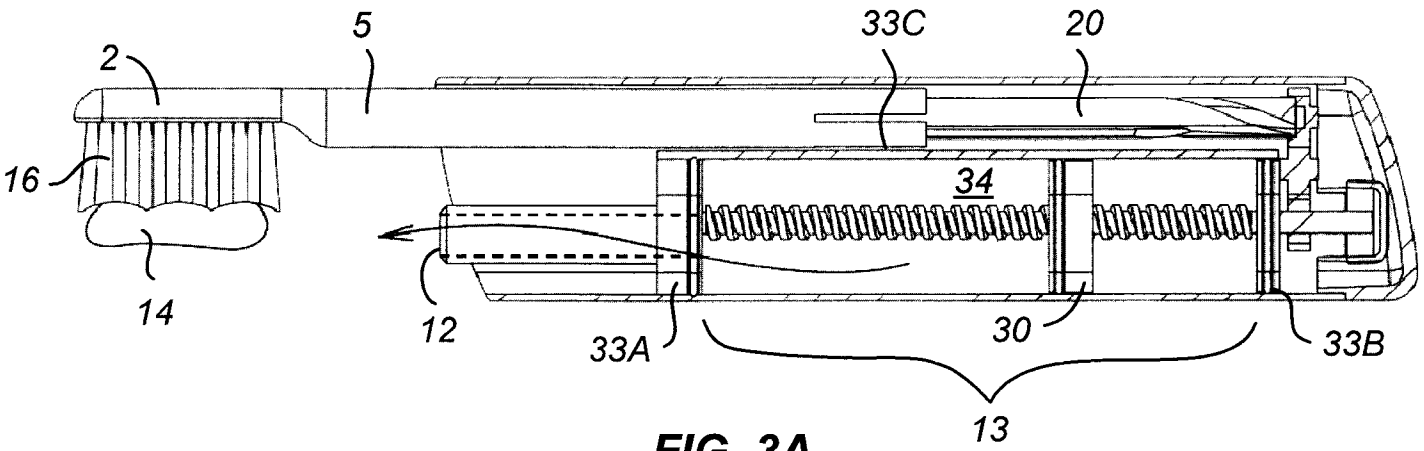
FIGS. 3A and 3B illustrate a cross-sectional view and a top view of the toothbrush system of the present invention with the brush head in the position shown in FIG. 2.
Figure 3B:
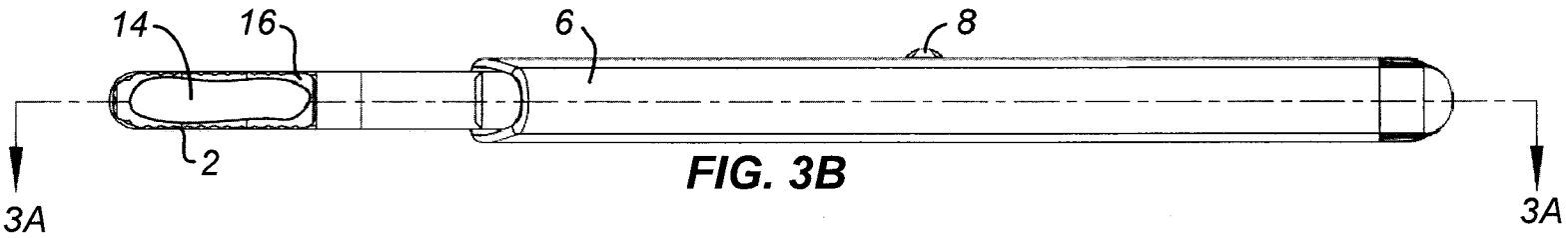

FIGS. 3A and 3B show a section view and a top view, respectively, of the travel toothbrush 1. The piston 30 of the paste dispensing assembly 13 is advanced by the threaded shaft 28 inside an elongated chamber defined by paste receptacle 34 which holds a volume of toothpaste. The elongated chamber is enclosed on both ends (by end members 33A and 33B) except for an exit through the nozzle 12. As the piston 30 is advanced in the chamber, the toothpaste is forced out of the nozzle 12 and onto an upper surface of the bristles.

Figure 4A:
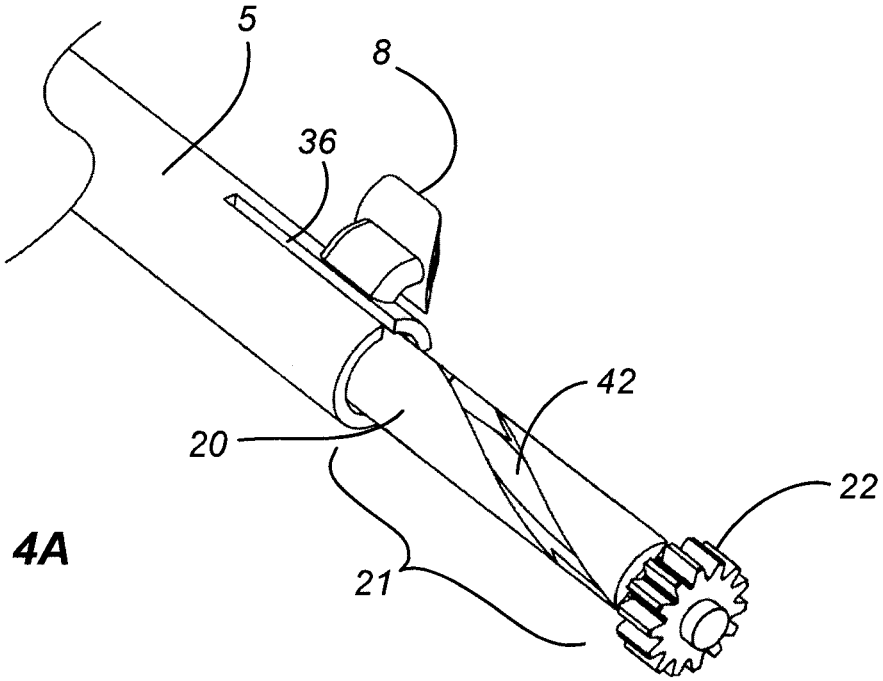
FIGS. 4A and 4B illustrate the stem rotation assembly of the exemplary embodiment of the toothbrush system of the present invention.
Figure 4B:
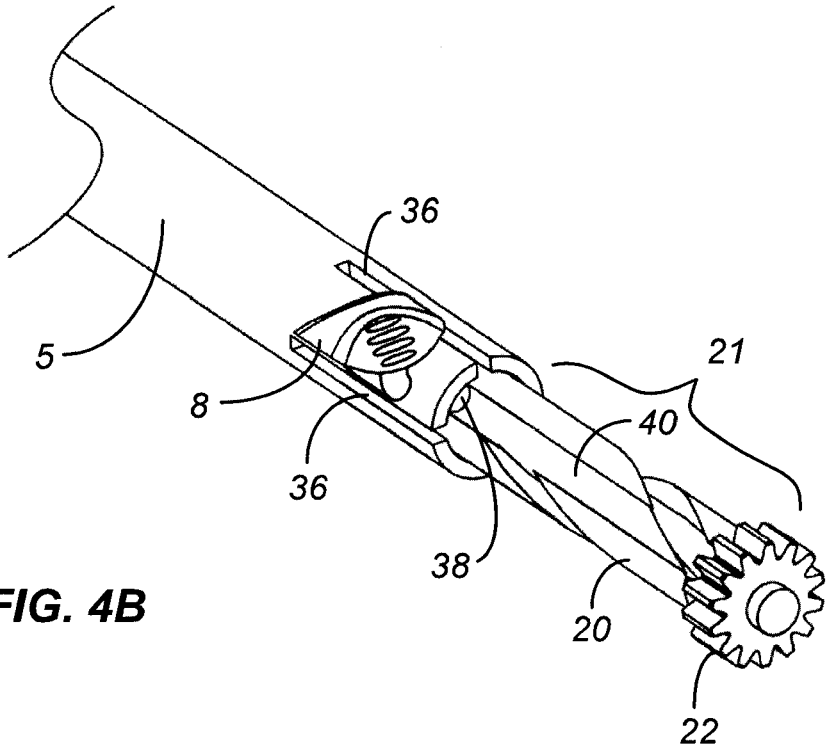

FIGS. 4A and 4B show two close-up views of the rotating mechanism 21 from different angles. The rotating mechanism 21 includes a proximal end of the sleeve 5 of the toothbrush stem assembly 4, the first gear 22, and the button 8. The sleeve has slots 36 on either side of the button that allow the button to flex in a spring-like manner. An inwardly protruding boss 38 is located on an inside surface of the sleeve 5. The boss 38 engages with both a straight groove 40 that runs along an axis of the shaft 20 and a helically curved groove 42 formed over a proximal portion of the shaft. The straight and curved grooves intersect as will be described in more detail below.

Figure 5A:
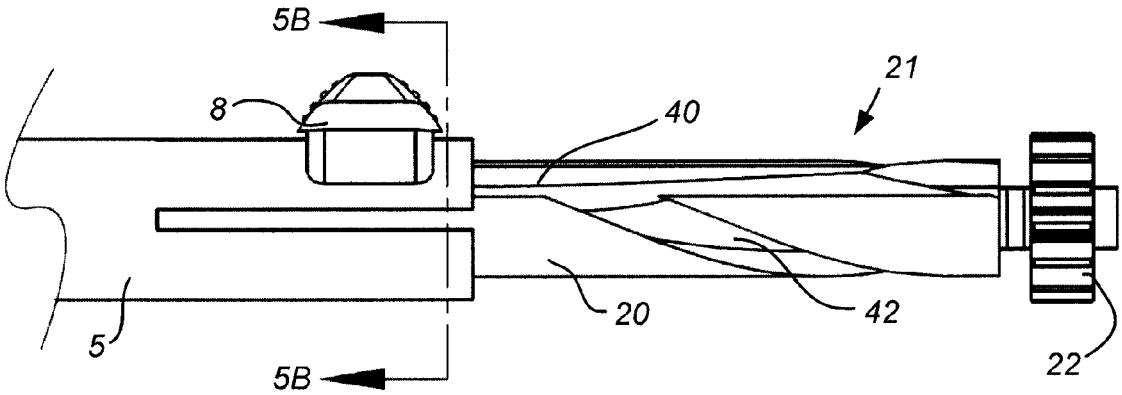
FIGS. 5A-5D are further detailed illustrations of the stem rotation assembly of the present invention including cross-sectional views.
Figure 5B:
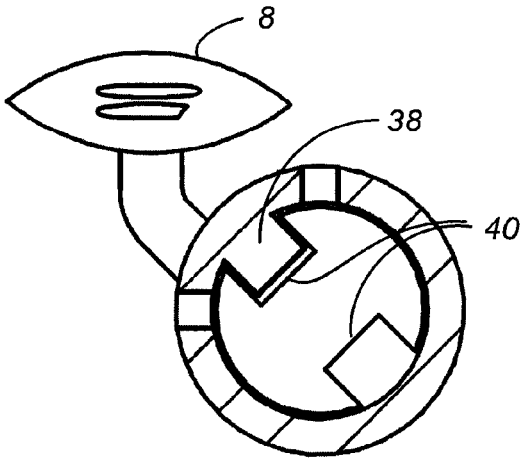
Figure 5C:
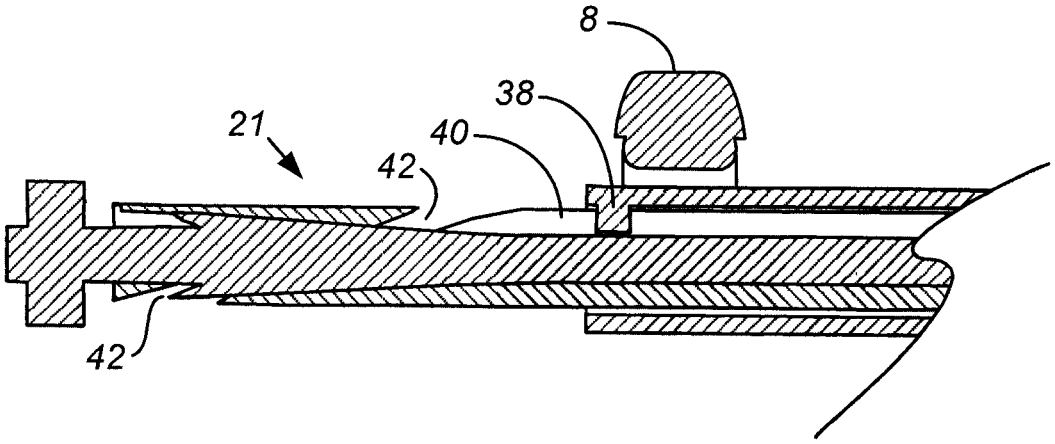
Figure 5D:
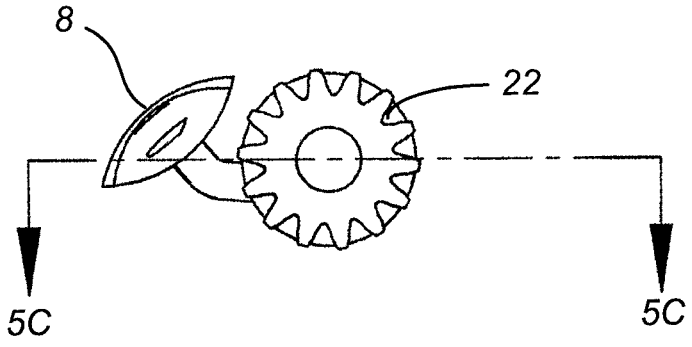

FIGS. 5A-5D illustrate the rotating mechanism 21 in more detail. FIG. 5C shows the inwardly protruding boss 38 under the button 8. The boss 38 can be aligned to travel in the straight groove 40 or alternatives in the helical groove 42. FIG. 5B shows the inwardly protruding boss 38 in the straight groove 40 with the button 8 carried on a tab between the slots 36 in the wall of sleeve 5 that allow the button to flex.

Figure 6B:
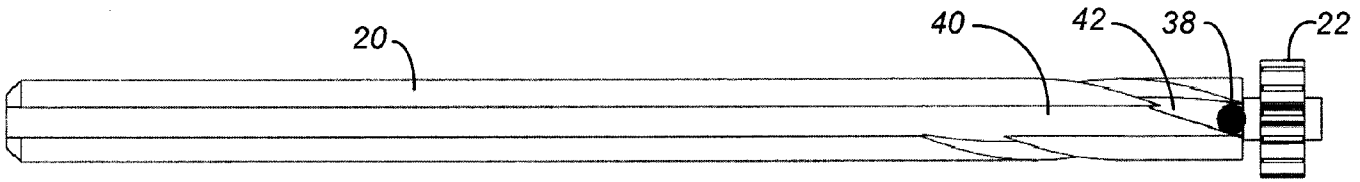
FIGS. 6A and 6B illustrate the stem assembly and the dispenser assembly of the exemplary embodiment of the toothbrush system of the present invention shown in their initial or stored configuration prior to advancement of the stem and dispensing of the toothpaste.
Figure 6A:
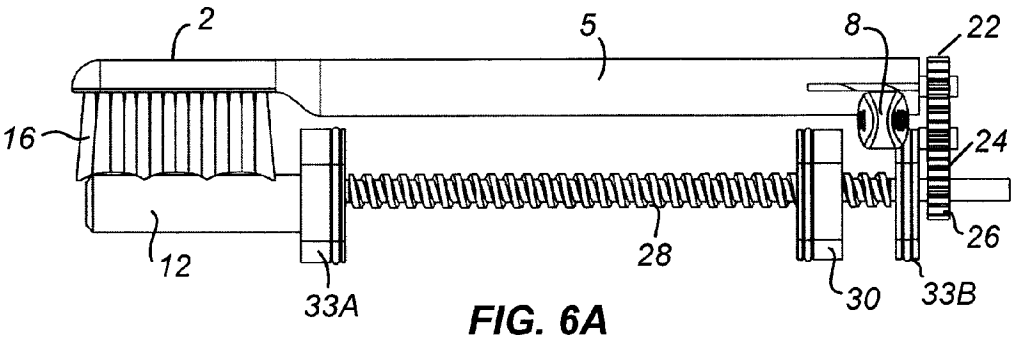

FIGS. 6A and 6B through FIGS. 11A and 11B illustrate how the stem assembly 4 and the paste dispensing assembly 13 of travel toothbrush 1 function together to simultaneously advance the brush head 2 from the protective case 6 (FIG. 1) and place a volume or line of toothpaste 14 along the top or crown of the bristles 16. Each of these figures shows the inward protruding boss 38 as a black dot positioned in the groove 40 or 42. In FIGS. 6A and 6B, the boss 38 is positioned fully proximally at one end of the groove 42, and the toothbrush head 2 is fully retracted into the case (although the case is not shown to simplify the drawing). The boss 38 is seated at a proximal end of in the curved groove 42 which is slightly deeper than the straight groove 40.

Figure 7B:
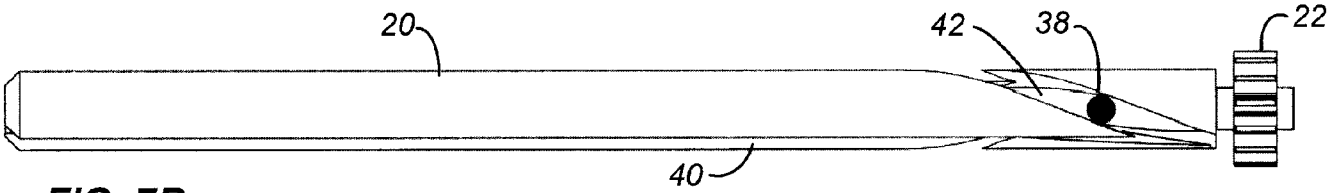
FIGS. 7A and 7B are similar to FIGS. 6A and 6B shown with the stem and brush head initially advanced with a small portion of toothpaste beginning to be dispensed.
Figure 7A:
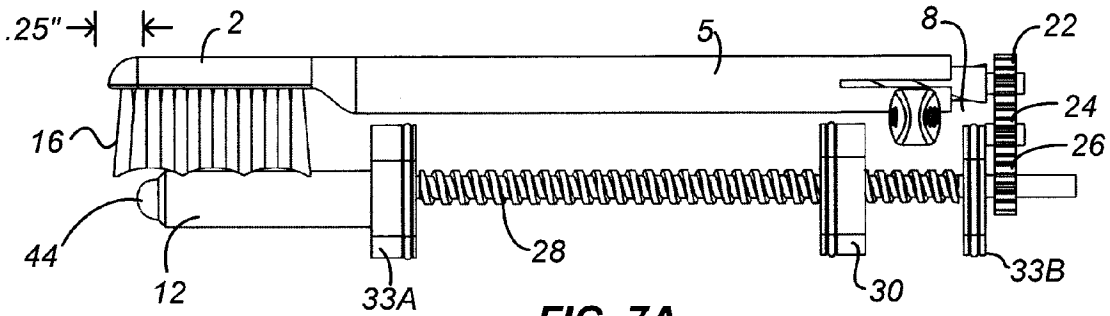

FIGS. 7A and 7B show the same views as FIG. 6 but with the sleeve 5 and toothbrush head 2 having been advanced by about 0.25 inch by manually pushing the button 8 forward. The inward protruding boss 38 remains engaged in the curved groove 42, and the shaft 20 has rotated 60 degrees from its original position. The gears 22, 24, and 26 have also rotated, which in turn rotates the threaded shaft 28 to advance the piston 30, thus forcing an initial portion of toothpaste 44 out of the nozzle 12 and onto the bristles 16.

Figure 8B:
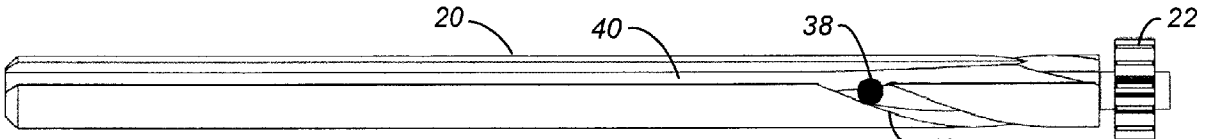
FIGS. 8A and 8B are similar to FIGS. 6A and 6B and FIGS. 7A and 7B, shown with the stem further advanced and paste further dispensed.
Figure 8A:
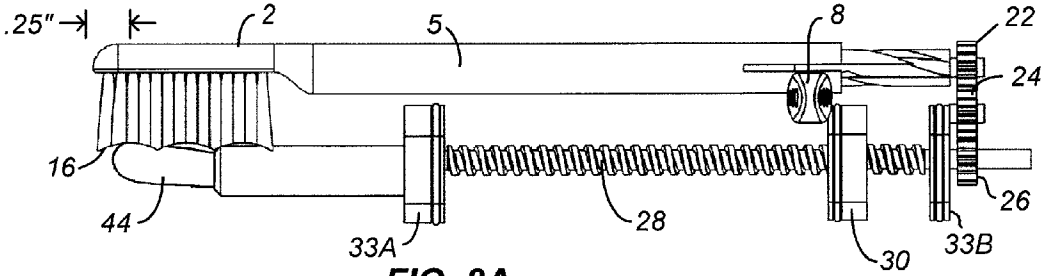

FIGS. 8A and 8B shows the progression of the rotating mechanism 20 as the button 8, toothbrush head 2, and inward protruding boss 38 are advanced another 0.25 inch distally. The shaft 20 has rotated 120 degrees, and the boss 38 is nearing the end of the curved groove 42 and is approaching entry into the straight groove 40. The piston 30 has advanced further, forcing more toothpaste 44 onto the bristles 16.

Figure 9B:
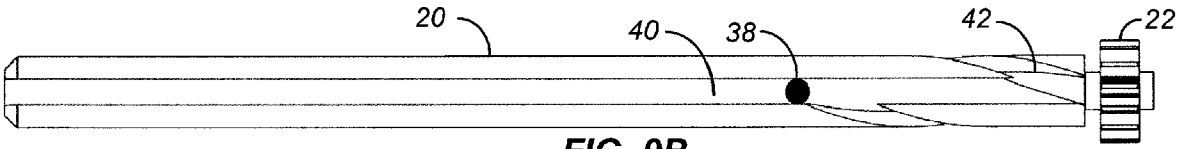
FIGS. 9A and 9B are similar to FIGS. 6A and 6B through FIGS. 8A and 8B, shown with the stem further advanced and the paste fully dispensed. At this point, the stem rotation mechanism which advances the paste dispenser will cease rotation and terminate paste dispensing.
Figure 9A:
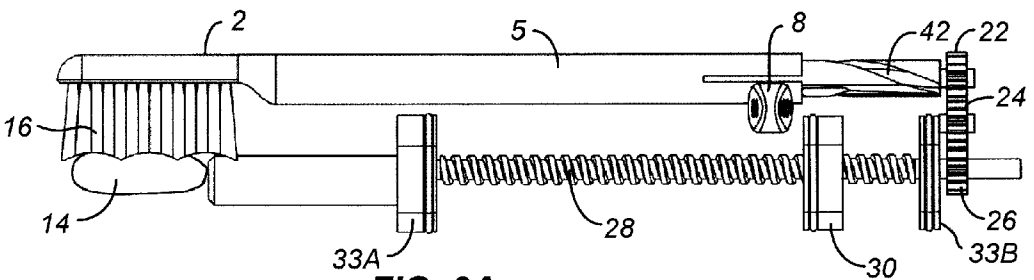

FIGS. 9A and 9B show the completion of the rotation of the shaft 20 by the rotating mechanism 21 as the inward protruding boss 38 enters the straight groove 40. The shaft 20 has now completed 180 degrees of rotation. The straight groove 40 allows the inward protruding boss to move forward freely to fully advance the sleeve 5 carrying the brush head 2 without further rotating the shaft 20. In this way, the application of the toothpaste is limited to cover the bristles of the toothbrush only.

Figure 10B:
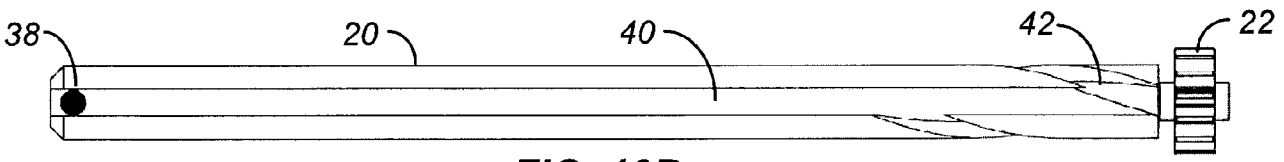
FIGS. 10A and 10B are similar to FIGS. 6A and 6B through FIGS. 9A and 9B, shown with the stem assembly fully advanced and the toothbrush system ready for use.
Figure 10A:
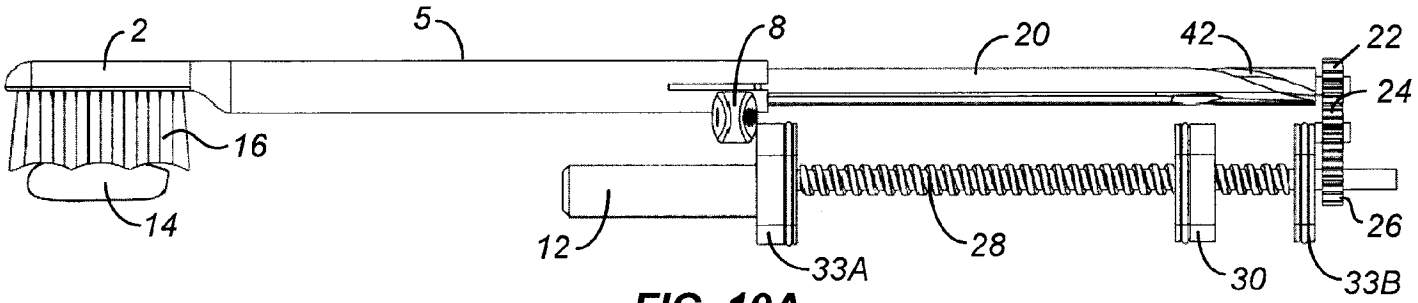
Figure 11B:
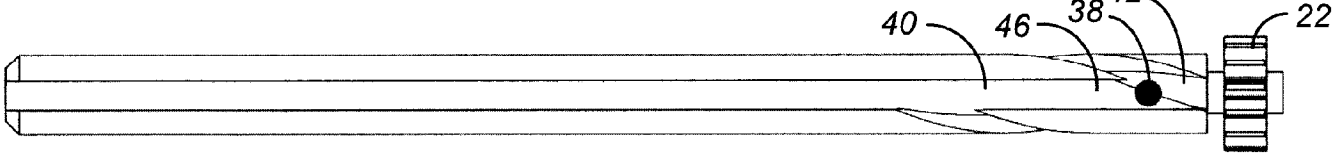
FIGS. 11A and 11B are similar to FIGS. 6A and 6B through FIGS. 10A and 10B, shown with the stem fully retracted after use but with the paste dispensing assembly partially advanced relative to the position shown in FIGS. 6A and 6B.
Figure 11A:
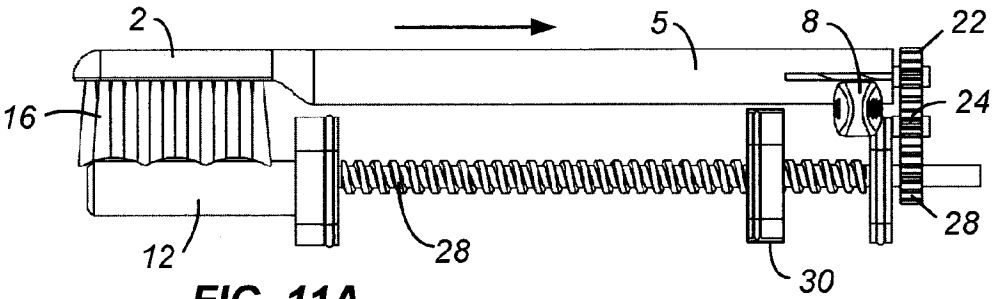

FIGS. 10A and 10B illustrates the brush head 2 fully extended with the inward protruding boss 38 now fully advanced in a distal direction and ready to be used for brushing FIGS. 11A and 11B show the toothbrush head 2 positioned as it would be when fully retracted into the protective case after use. The inward protruding boss 38 travels proximally up a ramp 46 in the straight groove 40 until it falls into the curved groove 42 which is deeper than the straight groove due to the ramp. The boss 38 will remain in the deeper curved groove 42 due to the spring force of the tab between slots 36 in the sleeve 5, as shown in FIGS. 4A and 4B. Because the boss 38 is now in a deeper groove (the curved groove 42), the boss 38 will follow that groove when it is next advanced forward. This will rotate the shaft as at the beginning of the sequence as previously explained. The only difference between the views of the stem assembly 4 and the paste dispensing assembly 13 in FIGS. 6A and 6B and in FIGS. 11A and 11B is that the piston 30 is at a starting location advanced distally due to dispensing of the first volume of toothpaste.

Figure 12:
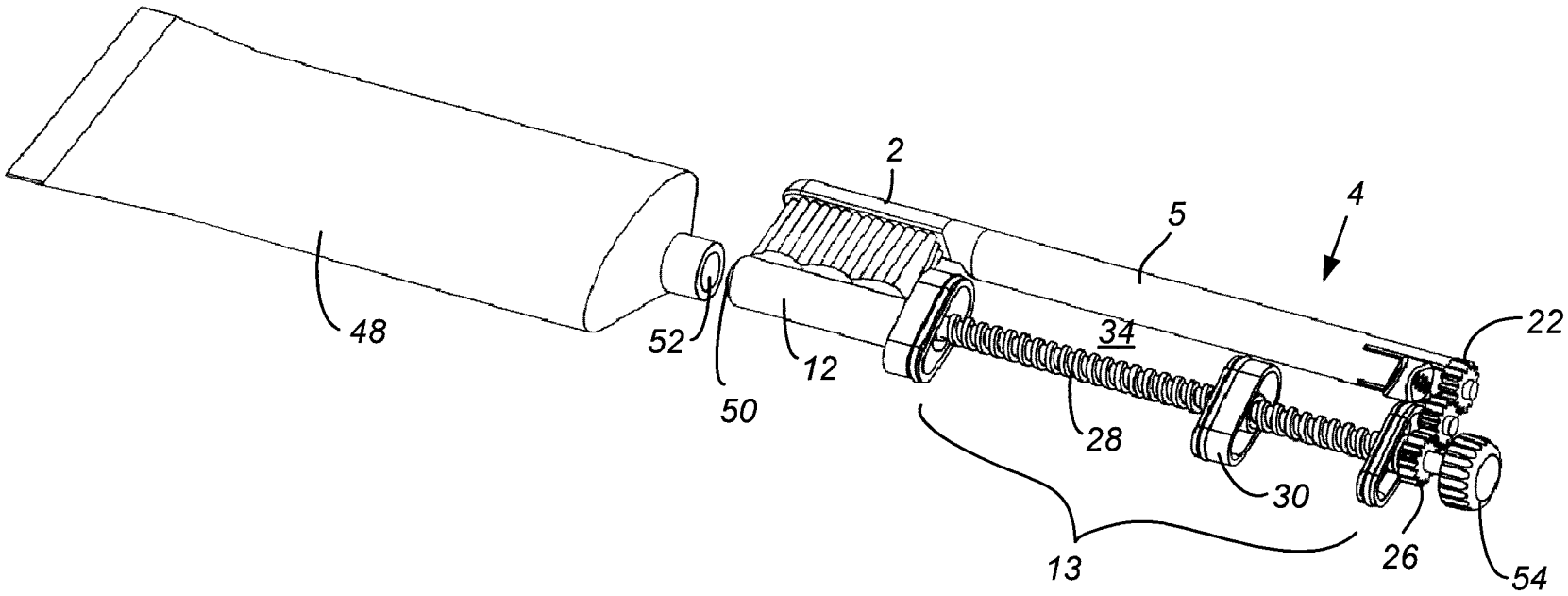
FIG. 12 illustrates the exemplary toothbrush system of the present invention being refilled from a conventional toothpaste tube.

FIG. 12 shows the internal components of the travel toothbrush with a toothpaste tube 48 aligned with the nozzle 12 to fill the chamber 34. The nozzle 12 has a conical end 50 to accommodate a variety of diameters of toothpaste tube openings. The conical end 50 is inserted into the opening 52 of the toothpaste tube, creating a seal. A knob 54 on the end of the threaded shaft 28 allows the user to rotate the shaft backwards to retract the piston 30 and open space within the receptacle 34. This will aspirate toothpaste from the toothpaste tube 48 into the chamber. Turning the knob 54 in the opposite direction will allow the user to advance the piston distally to extrude more toothpaste onto the brush head 16 if desired.

It should be recognized that a number of variations of the above-identified embodiments will be obvious to one of ordinary skill in the art in view of the foregoing description. Accordingly, the invention is not to be limited to those specific embodiments and methods of the present invention illustrated and described herein. Rather, the scope of the invention is to be defined by the claims and their equivalents.

What is claimed is:

1. A toothbrush system with an integrated paste dispenser, said toothbrush system comprising:

a protective case;

a stem assembly having a distal end, a proximal end, and a brush head at the distal end, said stem assembly being mounted to slide axially in the case to move the brush head between an extended position where the brush head is distal to the protective case and a retracted position where the brush head is within the protective case, wherein the stem assembly includes a button and a first gear which rotates as the stem assembly is advanced by the button and wherein the paste dispenser includes a threaded rod with a second gear which engages the first gear on the stem assembly so that advancement of the stem assembly by the button slide drives the threaded rod to advance a piston which is configured to dispense the toothpaste and wherein the stem assembly comprises a hollow distal portion and a rotating proximal portion, wherein the distal portion includes a boss that travels in a channel formed in the proximal portion, wherein the channel has a helical region whereby advancement of the distal portion over the proximal portion will cause the proximal portion to rotate the first gear to drive the threaded rod, and wherein the channel has a straight region distal to the helical region so that the distal portion can be further advanced without rotating the threaded rod and without dispensing additional toothpaste;

a paste dispenser mounted at least partly within the protective case and having a nozzle at a distal end thereof;

wherein the stem assembly is mechanically coupled to the paste dispenser to cause the paste dispenser to deliver a volume of paste each time the stem assembly is distally.

2. A toothbrush system as in claim 1, wherein the nozzle of the paste dispenser is disposed adjacent to the brush head so that paste is adapted to be laid on the brush head as the stem assembly and brush head are distally advanced when paste is present in the dispenser.

3. A toothpaste system as in claim 1, wherein the piston is located in a toothpaste receptacle in the protective case.

4. A toothpaste system as in claim 3, wherein the toothpaste receptacle is sufficiently large to hold multiple volumes of toothpaste so that one volume can be dispensed each time the stem assembly is advanced up to a multiple number of times.

5. A toothbrush system as in claim 1, wherein the button travels in a slot formed in a side of the protective case so that a user can advance the brush head and dispense the toothpaste with a single advancement of the button.

6. A toothbrush system as in claim 1, further comprising a knob on the rod to allow the rod to be manually rotated to advance or retract the piston.

7. A method for dispensing toothpaste, said method comprising:

providing a toothpaste system including a protective cover, a stem assembly having a brush head at its distal end, and a paste dispenser;

distally advancing the stem assembly over a predetermined length to move the brush head from a location in the protective cover to a position distal to the protective cover;

wherein distally advancing the stem assembly causes the paste dispenser to deliver a quantity of toothpaste to the brush head as the brush head moves outwardly from the protective cover by a nozzle on the paste dispenser, wherein the paste dispenser automatically stops delivering paste when the brush head has moved beyond the nozzle while the stem assembly continues to be advanced over the predetermined length.

8. A method as in claim 7, further comprising proximally retracting the stem assembly to draw the brush head back into the protective cover.

9. A method as in claim 8, further comprising distally advancing the stem assembly at least one additional time to cause the paste dispenser to deliver an additional quantity of toothpaste to the brush head as the brush head moves by the nozzle.

10. A method as in claim 7, wherein advancing the stem assembly comprises sliding a button on the side of the protective cover.

11. A method as in claim 7, wherein paste is dispensed during an initial portion of travel of the stem assembly and is not dispensed during the remaining portion of travel of the stem assembly.

12. A method as in claim 7, wherein distally advancing the stem assembly causes the paste dispenser to advance a piston within the protective cover to deliver the quantity of toothpaste.

13. A method as in claim 7, further comprising aligning the nozzle with a source of toothpaste and retracting the piston to draw toothpaste from the source into the protective cover.

14. A method as in claim 7, wherein the toothpaste is in a replaceable cartridge, further comprising replacing the cartridge in the protective cover.

15. A toothbrush system as in claim 1, wherein the paste dispenser is further configured so that retraction of the piston aspirates toothpaste back into the paste dispenser.

* * * * *